US008567103B2

(12) United States Patent
Wolf

(10) Patent No.: US 8,567,103 B2
(45) Date of Patent: Oct. 29, 2013

(54) ELASTIC WRISTBAND

(76) Inventor: Brandon Wolf, Youngstown, OH (US)

( * ) Notice: Subject to any disclaimer, the term of this patent is extended or adjusted under 35 U.S.C. 154(b) by 0 days.

(21) Appl. No.: 13/385,152

(22) Filed: Feb. 6, 2012

(65) Prior Publication Data

US 2013/0199067 A1 Aug. 8, 2013

(51) Int. Cl.

| | |
|---|---|
| ***A44C 5/00*** | (2006.01) |
| ***G09F 3/14*** | (2006.01) |
| ***G09F 3/00*** | (2006.01) |

(52) U.S. Cl.
USPC ..... 40/633; 40/665; 40/306; 40/310; 63/3; 63/11

(58) Field of Classification Search
USPC ..... 40/633, 665, 306, 310; 63/3, 11
See application file for complete search history.

(56) References Cited

U.S. PATENT DOCUMENTS

| | | | | |
|---|---|---|---|---|
| 2,111,518 | A * | 3/1938 | Wallace | 40/334 |
| 7,805,871 | B2 * | 10/2010 | Ciarrocchi | 40/633 |
| 2005/0081280 | A1 * | 4/2005 | Allgood | 2/209.3 |
| 2007/0066088 | A1 * | 3/2007 | Rambosek et al. | 439/37 |
| 2009/0094870 | A1 * | 4/2009 | Isserow et al. | 40/306 |
| 2012/0159988 | A1 * | 6/2012 | Baird et al. | 63/11 |

* cited by examiner

*Primary Examiner* — Syed A Islam
(74) *Attorney, Agent, or Firm* — Paul & Paul

(57) ABSTRACT

An elastic wristband with an elongate strip of injection molded resilient thermoplastic material and one or more graphic panels. The elongate strip includes a center portion, a left side portion and a right side portion joined by left and right living hinges. The central portion includes recessed areas for receiving the graphic panels. The central portion of the elongate strip also includes end tabs that are welded together to form a continuous circular band. The band is elastic in nature and can fit over a person's hand and onto a person's wrist to form a decorative wristband.

9 Claims, 3 Drawing Sheets

ELASTIC WRISTBAND

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of decorative wristband bracelets and more specifically to a customizable elastic wristband.

Decorative wrist bands have been worn by people from all countries for thousands of years.

They can be made out of rigid materials such as metal, wood or plastic, and may have a hinged portion and clasp to allow the user to fit the band around the wrist without needing to ride over the larger hand portion. Some wristbands are made of flexible material such as leather or fabric or rubber. Rubber is one of the only materials that is elastic and can therefore by placed on a person's wrist without the need for a hinge or clasp. The band can simply be stretched to fit over the hand portion and then released once the band is in the area of the wrist.

In recent times, rubber bracelets have been used and worn to tell the world that you support a certain cause. For example, a person might wear a pink breast cancer bracelet to tell the world that you support breast cancer research. The bracelet may have lettering embossed into it that identifies the cause. The bracelets are made of cast rubber or silicone, which is a form of rubber. However, there is a deficiency in the prior technology in that each bracelet must be manufactured for a specific purpose. A breast cancer bracelet can not also be set up to be a diabetes bracelet, or a bracelet that has a sports team logo printed on it. Therefore it would be ideal to have a universal elastic bracelet that can be adapted to include any graphic image of choice depending on the likes and interests of the user.

BRIEF SUMMARY OF THE INVENTION

The primary object of the invention is to provide an elastic wristband that allows a user to customize the band with insertable graphic panels.

Another object of the invention is to provide an elastic wristband that is translucent and allows the graphic panels stored within the band to be seen.

Another object of the invention is to provide an elastic wristband that is manufactured in strip form and then welded to form a continuous band.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an elastic wristband comprising: an elongate strip of injection molded translucent, resilient thermoplastic material and one or more graphic panels, said elongate strip including an elongate center portion, an elongate left side portion and an elongate right side portion, said right and left side potions joined to said elongate center portion along its elongate edges by integral living hinge members, said central portion including recessed areas for receiving said graphic panels, said central portion of said elongate strip including end tabs, said end tabs capable of being welded together to form a continuous circular band, and said band being elastic in nature and capable of fitting over a person's hand and onto a person's wrist to form a decorative wristband.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
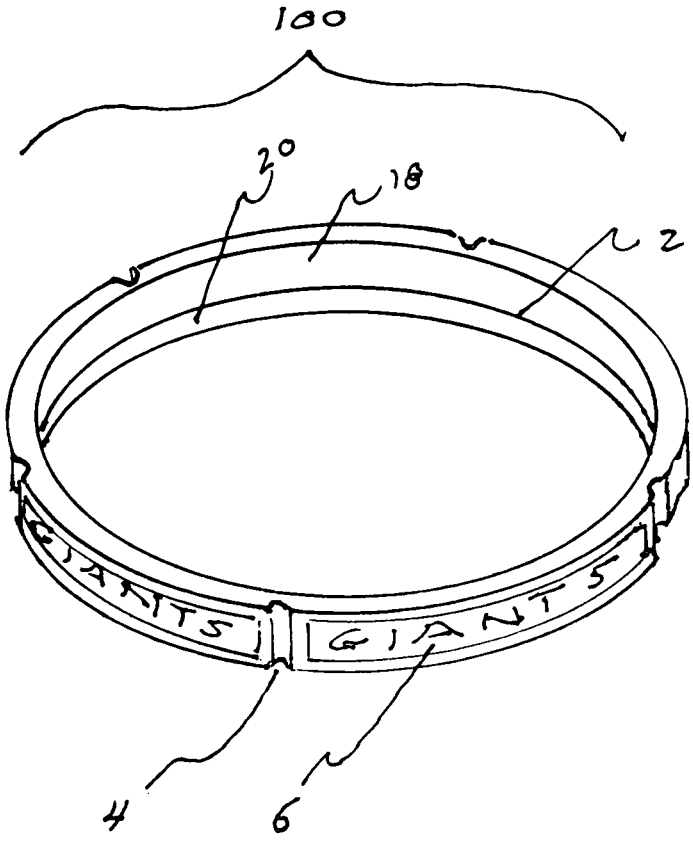
FIG. 1 is a perspective view of the invention in bracelet form.

Referring now to FIG. 1, we see a perspective view of the invention wristband 100 in the closed circular position. The circular band has an outside face and an inside face and includes a plurality of vertically oriented indentations 4 each extending transversely to the wristband elongate direction on the outside face each at a position between recess locations 8 to allow for easier injection molding.

An example of such a plastic is Versaflex® CL 40 manufactured by GLS Corporation in McHenry Ill. However other manufacturers also make similar elastic moldable plastics. Because the plastic is almost transparent, a graphic panel 6 installed within the wristband 100 can be clearly seen. A seam line 2 is the edge of folded outer strips 18, 20.

Figure 2:
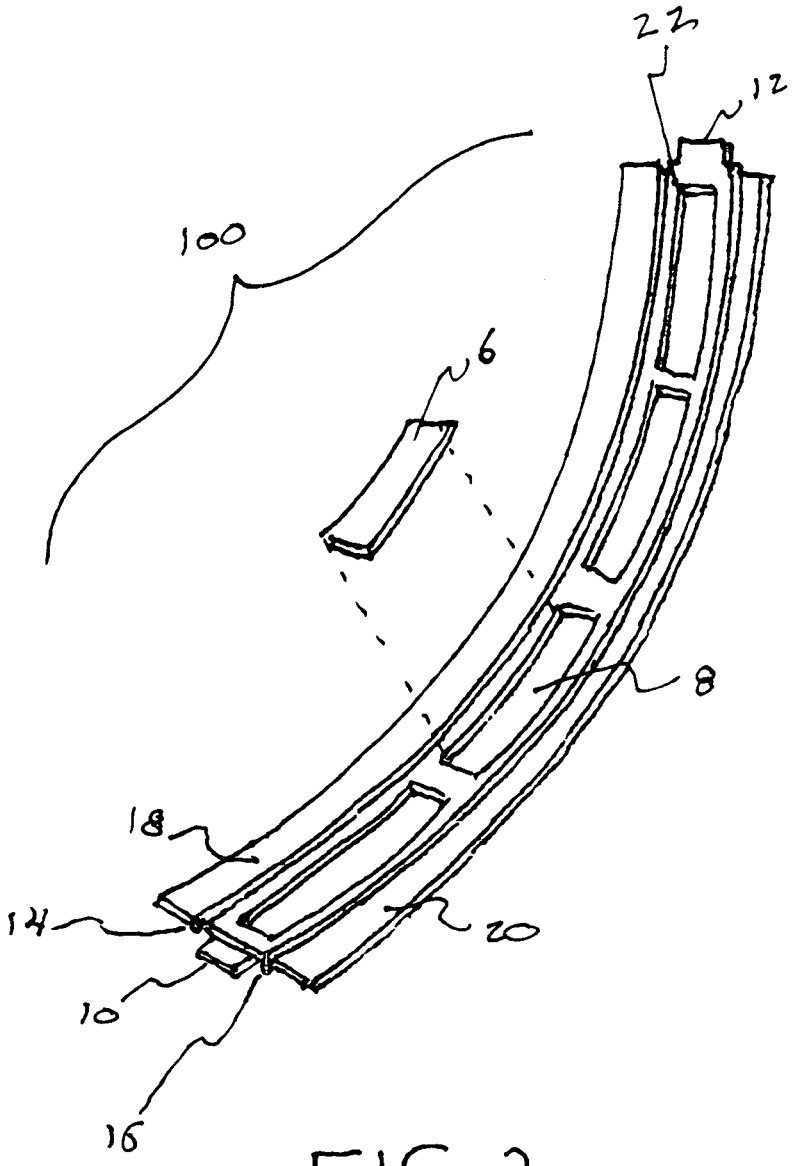
FIG. 2 is a perspective view of the invention in strip form.

FIG. 2 shows a perspective view of the invention wristband 100 in the open position just after being released from an injection mold. The elongate strip includes an integral elongate central strip 22, an elongate left side strip 18 and an elongate right side strip 20. The left side strip 18 is attached to the left elongate edge of the central strip 22 by a first living hinge 14. The right side strip 20 is attached to the right elongate edge of the central strip 22 by a second living hinge 16. The recessed areas for receiving the graphic panels are the depressions 8 which are positioned at plural successive locations on the central strip 22 to allow room for the insertion of a graphic panel 6. After the graphic panels 6 are inserted, the left and right side strips 18, 20 are folded over and the end tabs 10, 12 are overlapped on each other and heat welded together forming a circular wrist band 100 as shown in FIG. 1. The graphic panels 6 can be customized to show a sports team as shown in FIG. 1, or a special cause, such as fighting breast cancer, or simply a decorative colorful design. The present design allows a user to fold open the side strips 18, 20 and change the decorative panels 6 stored inside the wristband 100.

Figure 3:
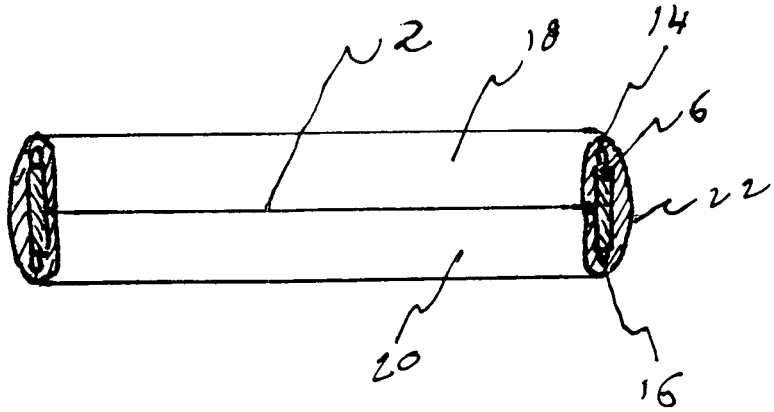
FIG. 3 is a side section view of the invention.

FIG. 3 shows a side section view that bisects the invention 100 when in the finished circular shape. Graphic panel 6 can be clearly seen trapped inside the outer central strip 22 and inner strips 18, 20. The invention is economical to manufacture and can fit a variety of wrist sizes due to its elastic quality. Obviously various diameters of wristbands 100 can be manufactured for children or adults.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A decorative wristband, comprising:

an elongate strip of injection molded resilient thermoplastic material having an elongate center strip portion, an elongate left side strip portion and an elongate right side strip portion;

wherein said left and right side elongate strip portions are joined to said elongate center strip portion by integral living hinge members;

wherein said elongate central strip portion includes recessed areas at successive locations along said center strip portion inside face;

wherein said elongate center strip portion has end tabs capable of being welded together to form a continuous circular band;

one or more graphic panels positioned one each in a respective recess area; and wherein said band is elastic and capable of fitting over a person's hand and onto the wrist.

2. The decorative wristband of claim 1, wherein said left side and right side elongate side strip portions are foldable onto said center elongate strip portion inside face to hold said graphic panels in their respective recess area locations.

3. The decorative wristband of claim 1, wherein said left side and right side elongate side strip portions, said elongate center strip portion, and said first and second living hinge members are of almost transparent plastic whereof said graphic panels can be clearly seen.

4. The decorative wristband of claim 3, wherein said plastic is Versaflex® CL 40.

5. The decorative wristband of claim 1, also including a plurality of indentations in the outside face of said elongate center strip portion, being positioned one each respectively between recess locations of said elongate center strip portion.

6. The decorative wristband of claim 5, wherein said plurality of indentations in the outside face of said elongate center strip portion each extend in the transverse direction to said center strip portion elongate direction.

7. The decorative wristband of claim 1, wherein said graphic panels are changeable.

8. The decorative wristband of claim 7, wherein said changeable graphic panels are respectively insertable into and removable from said recess areas.

9. The decorative wristband of claim 1, wherein said positioned graphic panels can be clearly seen.

* * * * *